US007701694B2

(12) United States Patent
Bolle

(10) Patent No.: US 7,701,694 B2
(45) Date of Patent: Apr. 20, 2010

(54) ARMAMENT FUSE ARRANGEMENT

(75) Inventor: Cristian A Bolle, Bridgewater, NJ (US)

(73) Assignee: Alacatel-Lucent USA Inc., Murray Hill, NJ (US)

( * ) Notice: Subject to any disclaimer, the term of this patent is extended or adjusted under 35 U.S.C. 154(b) by 1014 days.

(21) Appl. No.: 10/817,986

(22) Filed: Apr. 5, 2004

(65) Prior Publication Data

US 2005/0217467 A1 Oct. 6, 2005

(51) Int. Cl.

| | |
|---|---|
| ***F23Q 7/00*** | (2006.01) |
| ***F23Q 21/00*** | (2006.01) |
| ***G01V 1/06*** | (2006.01) |
| ***H05B 43/02*** | (2006.01) |
| *F42B 12/20* | (2006.01) |
| *F42C 1/00* | (2006.01) |
| *C06C 7/00* | (2006.01) |

(52) U.S. Cl. ..... 361/248; 361/250; 102/396; 102/272; 102/275.9; 102/275.11

(58) Field of Classification Search ..... 361/247, 361/249, 251–252; 102/369, 379, 397, 200, 102/202.1–202.4, 206, 265–266, 274–275
See application file for complete search history.

(56) References Cited

U.S. PATENT DOCUMENTS

| | | | | |
|---|---|---|---|---|
| 5,131,328 A | 7/1992 | Chan | ..... | 102/229 |
| 6,314,887 B1 | 11/2001 | Robinson | ..... | 102/262 |
| 6,622,629 B2 * | 9/2003 | Hodge et al. | ..... | 102/235 |
| 2003/0070571 A1 | 4/2003 | Hodge et al. | ..... | 102/221 |

FOREIGN PATENT DOCUMENTS

| | | |
|---|---|---|
| EP | 1 189 012 A | 3/1992 |

OTHER PUBLICATIONS

J. H. Henderson et al., "Two Novel Monolithic Silicon Substrate Slapper Detonators", *Conference Record of the Industry Applications Society Annual Meeting*, 1993, Oct. 2-8 1993, vol. 3, pp. 2479-2482.
R. Mendes et al., "Shock Initiation Of Explosives By Micro Slapper", *Technical Papers Of 12th International Detonation Symposium*, San Diego, CA, Aug. 11-16, 2002.

* cited by examiner

*Primary Examiner*—Jared J Fureman
*Assistant Examiner*—Dharti H Patel
(74) *Attorney, Agent, or Firm*—Eugene J. Rosenthal

(57) ABSTRACT

A highly reliable fuse for explosives and armaments is achieved by employing a micro mechanical device that operates to disrupt a relatively low impedance bypass circuit coupled in parallel with a relatively high impedance trigger mechanism. The removal of the electrical bypassing is performed as a result of the movement of the micro mechanical device to enable detonation under prescribed conditions. The electrical bypassing is removed by having at least one low impedance electrical bridge that is part of the bypass circuit break when the micro mechanical device is subjected to prescribed trigger activation forces, which are typically large forces, such as are generated during launch or impact. The micro mechanical device may be a micro-electrical mechanical system (MEMS) device and the bridge is at least one spring that is part of the MEMS device and also part of the bypass circuit.

36 Claims, 9 Drawing Sheets

ARMAMENT FUSE ARRANGEMENT

TECHNICAL FIELD

This invention relates to the art of fuses, and more particularly, to fuses for armaments such as missiles and bombs.

BACKGROUND OF THE INVENTION

It is desired that missiles and bombs explode only when specified conditions are met, such as upon reaching their targets. Otherwise, it is desired that such missiles and bombs can be handled safely. Thus, it is necessary for a missile or bomb to contain a fuse that can differentiate between motions resulting from normal handling, or even severe accidental drops, and between the motions that indicate a need to set off an explosion, e.g., launch or impact. In addition, it is desirable that the operational readiness, as well as the state of the fuse, be testable with the result being perceivable by a human being.

SUMMARY OF THE INVENTION

I have recognized that a highly reliable fuse for explosives and armaments can be achieved, in accordance with the principles of the invention, by employing a micro mechanical device that operates to disrupt a relatively low impedance bypass circuit coupled in parallel with a relatively high impedance trigger mechanism. The removal of the electrical bypassing is performed as a result of the movement of the micro mechanical device to enable detonation under prescribed conditions. In accordance with an aspect of the invention, the electrical bypassing is removed by having at least one low impedance electrical bridge that is part of the bypass circuit break when the micro mechanical device is subjected to prescribed trigger activation forces, which are typically large forces, such as are generated during launch or impact.

In one embodiment of the invention, the micro mechanical device is a micro-electrical mechanical system (MEMS) device and the bridge is at least one spring that is part of the MEMS device and also part of the bypass circuit. Breaking the at least one spring disrupts the bypass circuit, permitting current to pass through the high impedance trigger mechanism enabling detonation. In another embodiment of the invention, the bridge is a separate element from the MEMS device and motion of the MEMS device due to the trigger activation forces cause the MEMS device to move such that it breaks the bridge disrupting the bypass circuit, permitting current to pass through the high impedance trigger mechanism enabling detonation.

After moving so as to disrupt the bypass circuit, the MEMS device may be latched into its new position to prevent it from causing any other damage to the trigger, e.g., by moving around therein.

Motion of multiple MEMS devices may be required to fully remove the bypass circuit, which may be implemented as multiple parallel connections. Advantageously, the redundancy provided by employing multiple MEMS devices, and/or multiple bypass connections, results in greater system safety as well as the ability to design for any desired type of triggering condition. For example, if two MEMS devices are employed, each coupled to a separate bypass connection implemented as respective springs, the high impedance trigger mechanism will not be activated unless both springs are broken. For a redundancy application, the MEMS devices can be arranged such that both must move in the same direction in order to break both springs and activate the high impedance trigger mechanism. For control of the triggering condition, it may be that the MEMS devices must each move in opposite directions to cause their respective springs to break and thereby activate the high impedance trigger mechanism. Of course, various combinations can be implemented at the discretion of the implementer. Alternatively, a single MEMS device can be arranged to disrupt the bypass circuit by more than one motion, or two require at least two motions of the MEMS device.

The high impedance trigger mechanism may be a so-called "slapper", which is at least one high-impedance filament in contact with a dielectric membrane and which operates to generate a shock wave that triggers the explosion of a an explosive pellet when sufficient current is supplied to the high-impedance filament, which in turn causes the main charge of the armament to explode.

In accordance with another aspect of the invention, the fuse may be arranged so as various ones of its parts may be tested and an indication of the results that is perceivable by a human being provided. Furthermore, the fuse may be arranged to be tested both electrically as well as mechanically. For example, a test voltage may be applied, and the voltage at a point along the high-impedance filament is measured to verify the integrity of the high-impedance filament. Similarly, the impedance of the entire assembly may be tested by supplying a test voltage and measuring the resulting current. A high current indicates that the bypass circuit is intact. Electrodes may be positioned with respect to the MEMS device, and various voltages supplied to move the MEMS device. The change in capacitance, if any, that results from such movement may be measured, and from the measurement information about the mechanical condition of the MEMS device may be determined.

DETAILED DESCRIPTION

Figure 1:
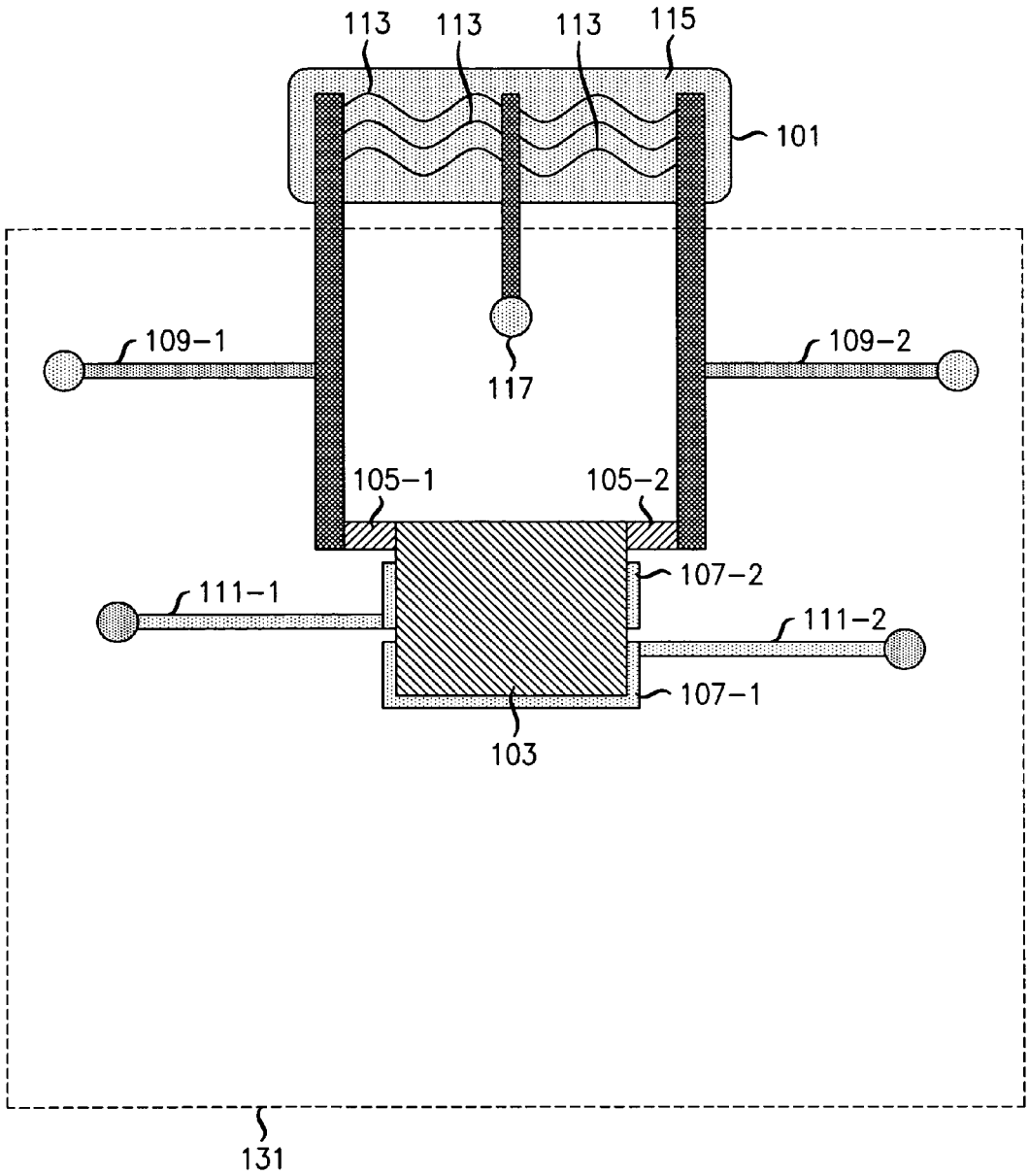
FIG. 1 shows an exemplary embodiment of the invention in which the micro mechanical device is a micro-electrical mechanical system (MEMS) device and the bridge is at least one spring that is part of the MEMS device and also part of the bypass circuit.

The following merely illustrates the principles of the invention. It will thus be appreciated that those skilled in the art will be able to devise various arrangements that, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that any block diagrams herein represent conceptual views of illustrative circuitry embodying the principles of the invention.

In the claims hereof any element expressed as a means for performing a specified function is intended to encompass any way of performing that function. This may include, for example, a) a combination of electrical or mechanical elements which performs that function or b) software in any form, including, therefore, firmware, microcode or the like, combined with appropriate circuitry for executing that software to perform the function, as well as mechanical elements coupled to software controlled circuitry, if any. The invention as defined by such claims resides in the fact that the functionalities provided by the various recited means are combined and brought together in the manner which the claims call for. Applicant thus regards any means which can provide those functionalities as equivalent as those shown herein.

Unless otherwise explicitly specified herein, the drawings are not drawn to scale.

The term micro-electromechanical systems (MEMS) device as used herein is intended to mean an entire MEMS device or any portion thereof. Thus, if a portion of a MEMS device is inoperative, or if a portion of a MEMS device is occluded, such a MEMS device is nonetheless considered to be a MEMS device for purposes of the present disclosure.

In the description, identically numbered components within different ones of the FIGs. refer to the same components.

A highly reliable fuse for explosives and armaments can be achieved, in accordance with the principles of the invention, by employing a micro mechanical device that operates to disrupt a relatively low impedance bypass circuit coupled in parallel with a relatively high impedance trigger mechanism. The removal of the electrical bypassing is performed as a result of the movement of the micro mechanical device to enable detonation under prescribed conditions. In accordance with an aspect of the invention, the electrical bypassing is removed by having at least one low impedance electrical bridge that is part of the bypass circuit break when the micro mechanical device is subjected to prescribed trigger activation forces, which are typically large forces, such as are generated during launch or impact.

FIG. 1 shows an exemplary embodiment of the invention in which the micro mechanical device is a micro-electrical mechanical system (MEMS) device and the bridge is at least one spring that is part of the MEMS device and also part of the bypass circuit. Breaking the at least one spring disrupts the bypass circuit, permitting current to pass through the high impedance trigger mechanism enabling detonation. More specifically, shown in FIG. 1 are a) relatively high impedance trigger 101; b) a MEMS device including mass 103 and optional electrodes 107, c) bridges 105-1 and 105-2, collectively herein bridges 105; d) electrical connection and test ports 109-1 and 109-2, collectively herein electrical connection and test ports 109; e) optional electrical connections 111-1 and 111-2, collectively herein electrical connections 111; and f) test port 117.

Relatively high impedance trigger 101 triggers an explosion when supplied with a sufficiently high current. The explosion is stimulated by the heating, due to the supplied current, of relatively high impedance wires 113 within the trigger. For example, trigger 101 may be a so-called "slapper" which includes relatively high impedance wires 113. Application of a sufficiently high current to relatively high impedance wires 113 causes wires 113 to heat up, causing material 115 to expand violently. This may in turn set a larger explosion, possibly as a result of a shockwave produced by the violent expansion of material 115. Such slappers and similar devices are known to those of ordinary skill in the art.

Mass 103 is coupled to bridges 105. MEMS device operates by the movement of mass 103 under prescribed conditions so as to exert sufficient force on bridges 105 so that at least one of them breaks. In one embodiment of the invention, bridges 105 support mass 103. In another embodiment of the invention mass 103 may be supported at least in part independently of bridges 105.

In accordance with an aspect of the invention, bridges 105 are part of a relatively low impedance bypass circuit leg which is electrically connected in parallel with, and which bypasses, trigger 101. Thus, so long as bridges 105 remain intact, a current of sufficiently high magnitude to cause detonation of explosive 115 cannot be applied across trigger 101. Therefore, trigger 101 cannot be operated and the armament does not explode.

Electrical connection and test ports 109-1 and 109-2 are used to supply the current which may be used to cause the explosion of trigger 101. However, so long as bridges 105 are intact, trigger 101 is effectively short circuited, and the current is simply shunted from one of electrical connection and test ports 109, through a first of bridges 105, through mass 103, through the other of bridges 105 and then out the other of electrical connection and test ports 109.

Optional electrodes 107 may employed to test the ability of mass 103 to move. By applying a test signal between one of electrical connection and test ports 109 and one of optional electrical connections 111, mass 103 may be caused to move. The motion of mass 103 may be detected by changes in the capacitance measured between the other of test ports 109 and the other of optional electrical connections 111. If the capacitance does not change, this indicates that mass 103 has not moved, and the trigger is defective.

In order to test that relatively high impedance wires 113 are intact and are connected to electrical connection and test ports 109, a small test voltage may be applied between electrical connection and test ports 109. A measurement of the voltage between test port 117 and one of electrical connection and test ports 109 provides information about the electrical integrity of relatively high impedance wires 113. More specifically, if test port 117 is located substantially at the midpoint of relatively high impedance wires 113, the voltage measured at test port 117 should be about one half of the small test voltage that was applied between electrical connection and test ports 109. Furthermore, by measuring the resulting test current should be relatively large if the bypass circuit made up of bridges 105 and mass 103 is intact.

In accordance with an aspect of the invention, relatively high impedance trigger 101 and connections thereto may be outside of sealed package 131, which includes the remainder of the fuse.

Figure 2:
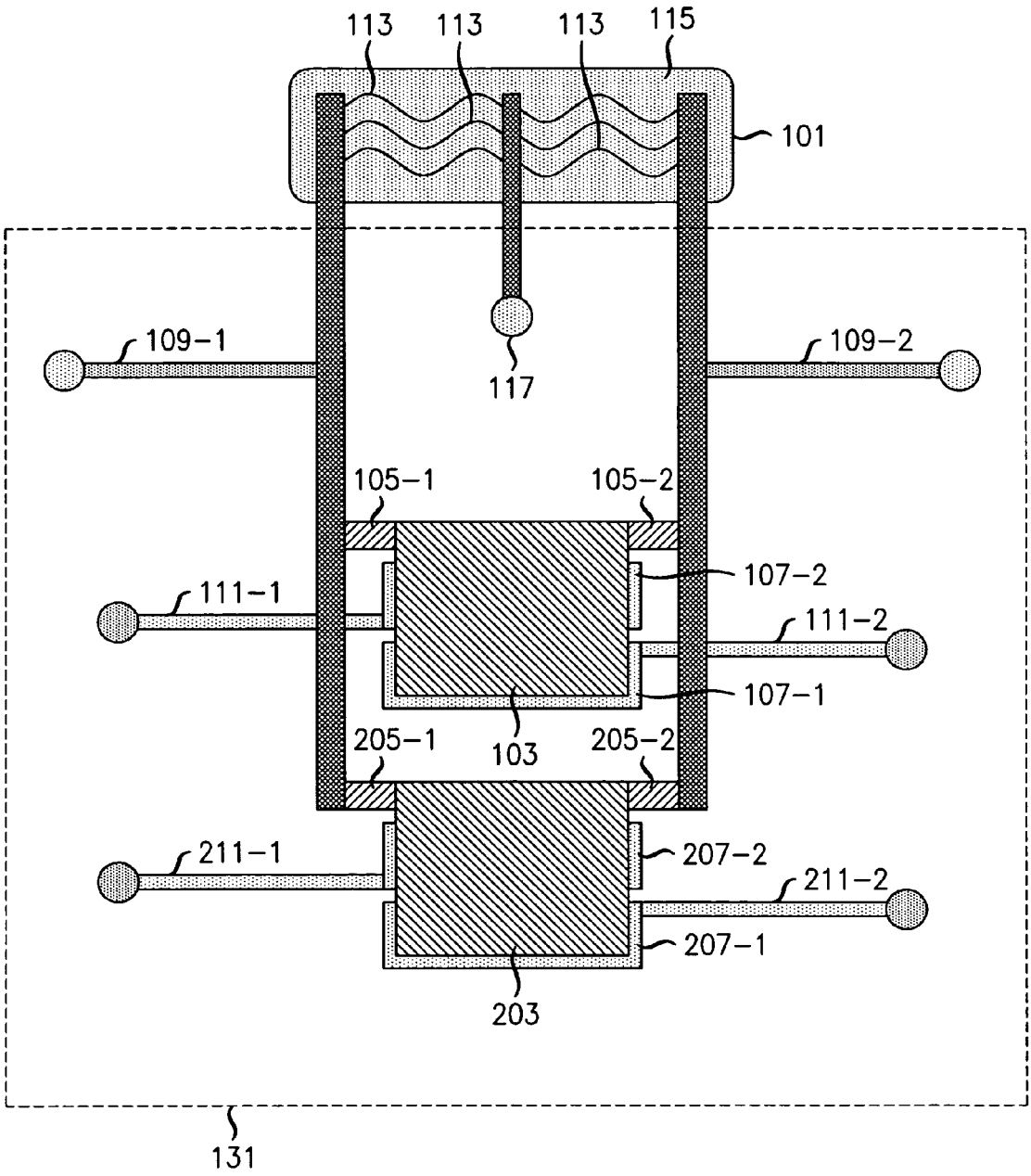
FIG. 2 shows another exemplary embodiment of the invention, similar to that shown in FIG. 1, but in which there are two bridges that are connected in parallel, each of which is coupled to a MEMS device.

FIG. 2 shows another exemplary embodiment of the invention, similar to that shown in FIG. 1, but in which there are two bridges that are connected in parallel, each of which is coupled to a MEMS device. Only by breaking at least one spring in each of the bridges is the bypass circuit disrupted and current permitted to pass through the high impedance trigger mechanism enabling detonation. FIG. 2 shows all the same elements as FIG. 1 but also includes g) a MEMS device including mass 203 and optional electrodes 207, h) bridges 205-1 and 205-2, collectively herein bridges 205; and i) optional electrical connections 211-1 and 211-2, collectively herein electrical connections 211. Operation of the additional elements of FIG. 2 are the same as their like-named and similarly numbered, except for the leading digit which indicates the FIG. of introduction, counterparts of FIG. 1. Advantageously, the embodiment of the invention of FIG. 2 provides a redundant safety mechanism not present in FIG. 1.

Figure 3:
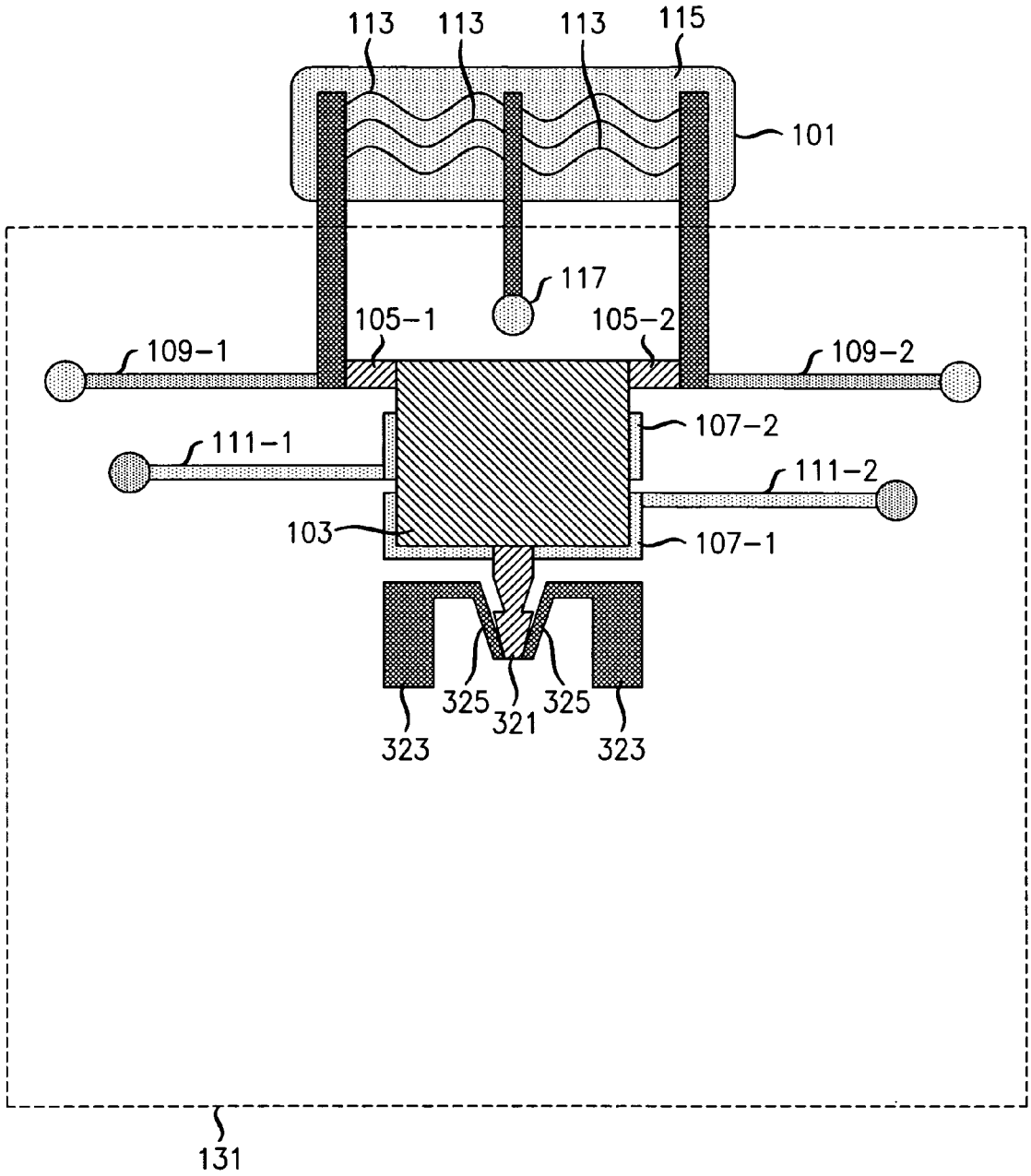
FIG. 3 shows another exemplary embodiment of the invention, similar to that shown in FIG. 1, but in which mass 103 is arranged to be latched in place after moving such that it broke at least one of the bridges.

FIG. 3 shows another exemplary embodiment of the invention, similar to that shown in FIG. 1, but in which mass 103 is arranged to be latched in place after moving such that it broke at least one of bridges 105. FIG. 3 shows all the same elements as FIG. I but also includes g) lockable tab 321 and h) lock receptacle 323. Lockable tab 321 is coupled to mass 103 and moves with mass 103 such that when mass 103 moves toward lock receptacle 323, tab 321 is inserted therein, forcing apart locking arms 325 of lock receptacle 323. Once at least a section of the widest part of tab 321 moves past locking arms 325, locking arms 325 are able to close again, prevent tab 321 from moving back out, and thereby locking in place mass 103. Advantageously, after the breaking of at least one of bridges 105, mass 103 is not permitted to move around freely, which may cause unwanted damage.

Figure 4:
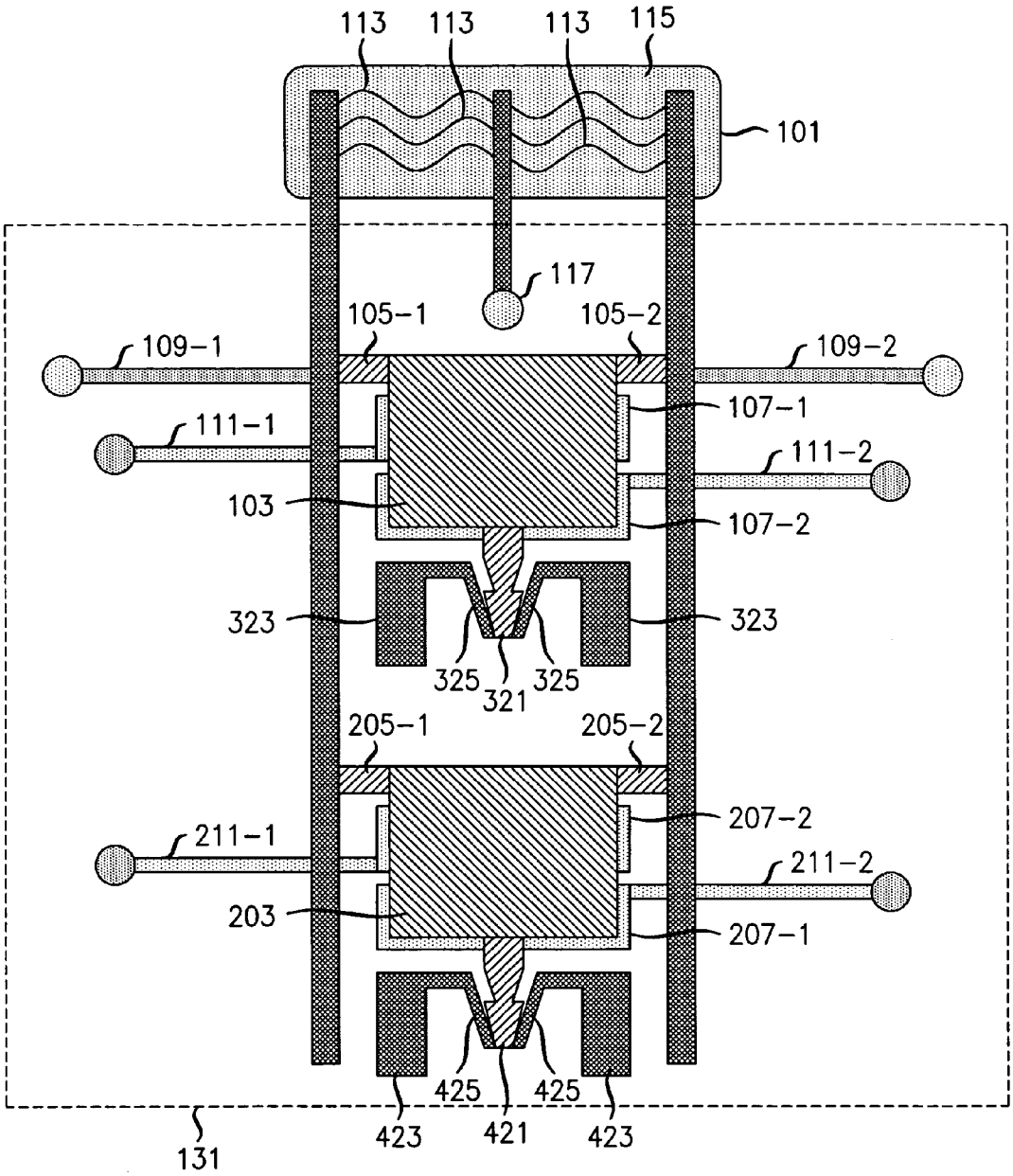
FIG. 4 shows another exemplary embodiment of the invention, similar to that shown in FIG. 2, but in which the two masses are arranged to be latched in place after moving and breaking at least one of their respective associated ones of the bridges in the same manner as shown in FIG. 3.

FIG. 4 shows another exemplary embodiment of the invention, similar to that shown in FIG. 2, but in which both masses 103 and 203 are arranged to be latched in place after moving and breaking at least one of their respective associated ones of bridges 105 and 205 in the same manner as shown in FIG. 3. FIG. 4 shows all the same elements as FIG. 2 but also includes j) lockable tab 321 k) and lock receptacle 323, l) lockable tab 421 m) and lock receptacle 423. As described in connection with FIG. 3, lockable tab 321 is coupled to mass 103 and moves with mass 103 such that when mass 103 moves toward lock receptacle 323, tab 321 is inserted therein, forcing apart locking arms 325 of lock receptacle 323. Once at least a section of the widest part of tab 321 moves past locking arms 325, locking arms 325 are able to close again, prevent tab 321 from moving back out, and thereby locking in place mass 103. Advantageously, after the breaking of at least one of bridges 105, mass 103 is not permitted to move around freely, which may cause unwanted damage. Similarly, lockable tab 421 is coupled to mass 203 and moves with mass 203 such that when mass 203 moves toward lock receptacle 423, tab 421 is inserted therein, forcing apart locking arms 425 of lock receptacle 423. Once at least a section of the widest part of tab 421 moves past locking arms 425, locking arms 425 are able to close again, prevent tab 421 from moving back out, and thereby locking in place mass 203. Advantageously, after the breaking of at least one of bridges 105 or 205, mass 103 or mass 203 are not permitted to move around freely, which may cause unwanted damage.

Figure 5:
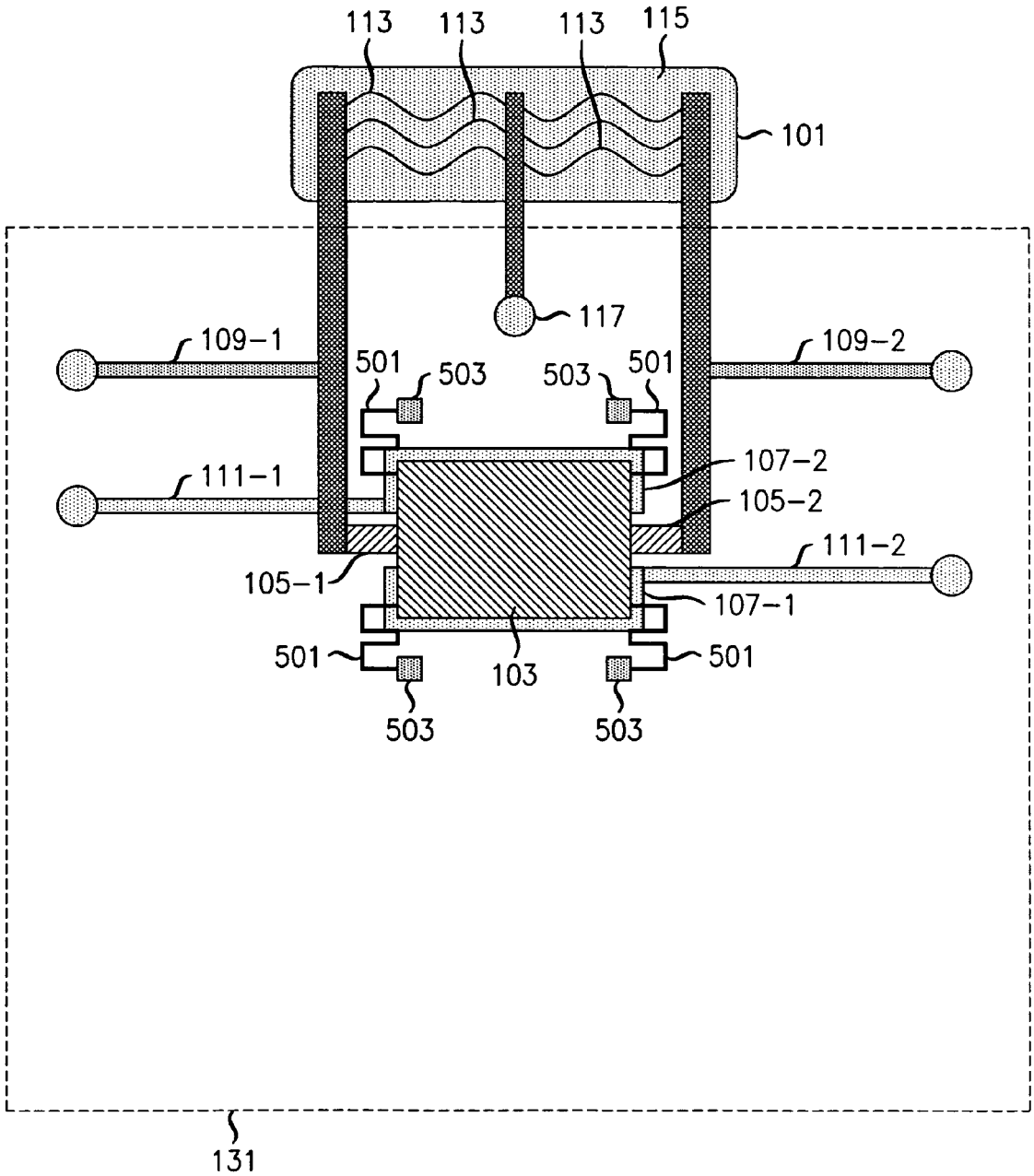
FIG. 5 shows another exemplary embodiment of the invention, similar to that shown in FIG. 1, but in which there are springs coupling the mass to posts that are attached to the substrate on which the electrodes sit.

FIG. 5 shows another exemplary embodiment of the invention, similar to that shown in FIG. 1, but in which there are springs 501 coupling mass 103 to posts that are attached to the substrate on which sit electrodes 107. Springs 501 prevent mass 103 from move around freely, which may cause unwanted damage, after the breaking of at least one of bridges 105.

Figure 6:
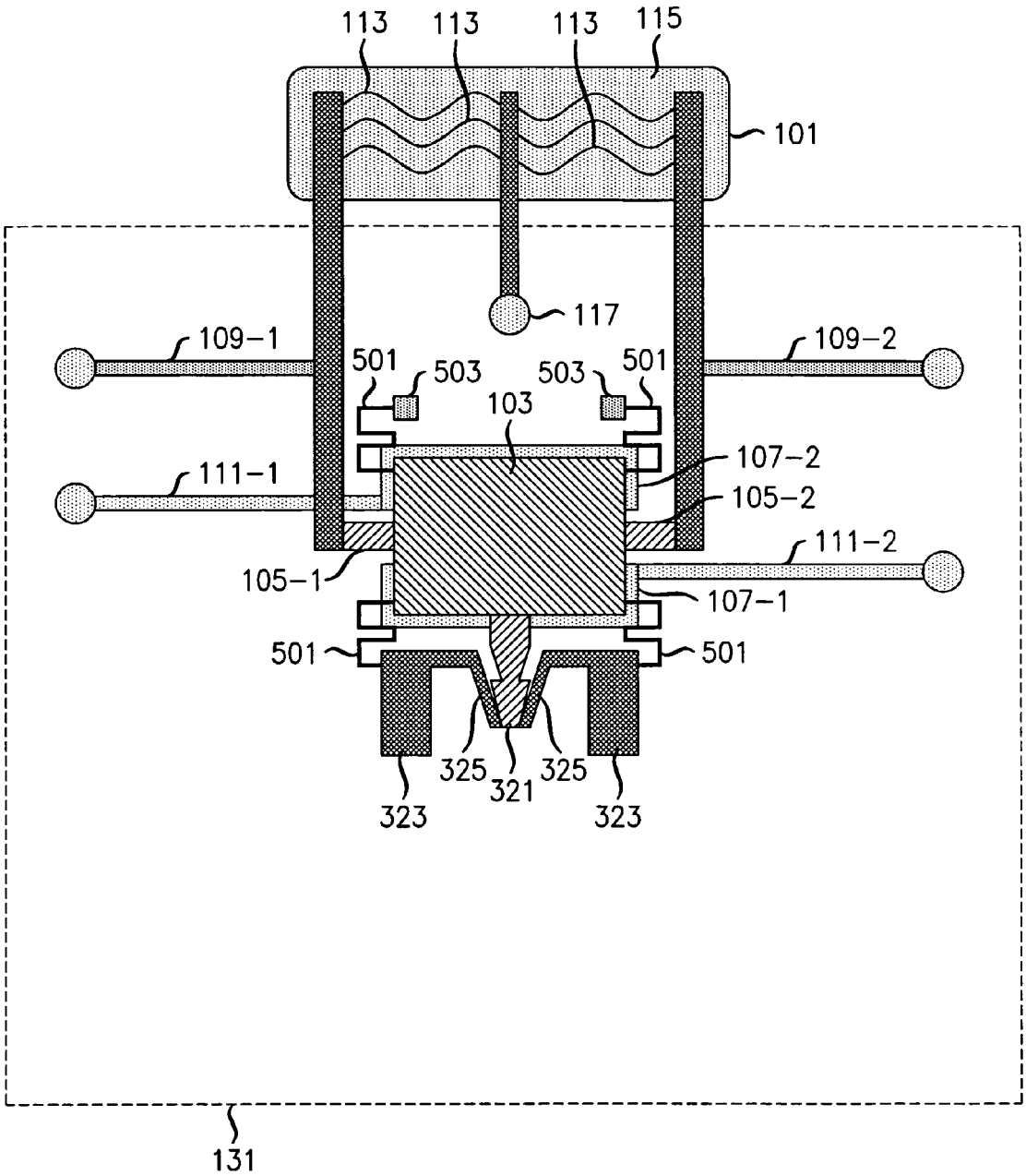
FIG. 6 shows another exemplary embodiment of the invention, similar to that shown in FIG. 5, but also including the locking mechanism of FIG. 3.

FIG. 6 shows another exemplary embodiment of the invention, similar to that shown in FIG. 5, but also including the locking mechanism of FIG. 3. Not only do springs 501 prevent mass 103 from moving around freely, but, as in FIG. 3, mass 103 is also locked in place by the insertion of tab 321 into lock receptacle 323.

Figure 7:
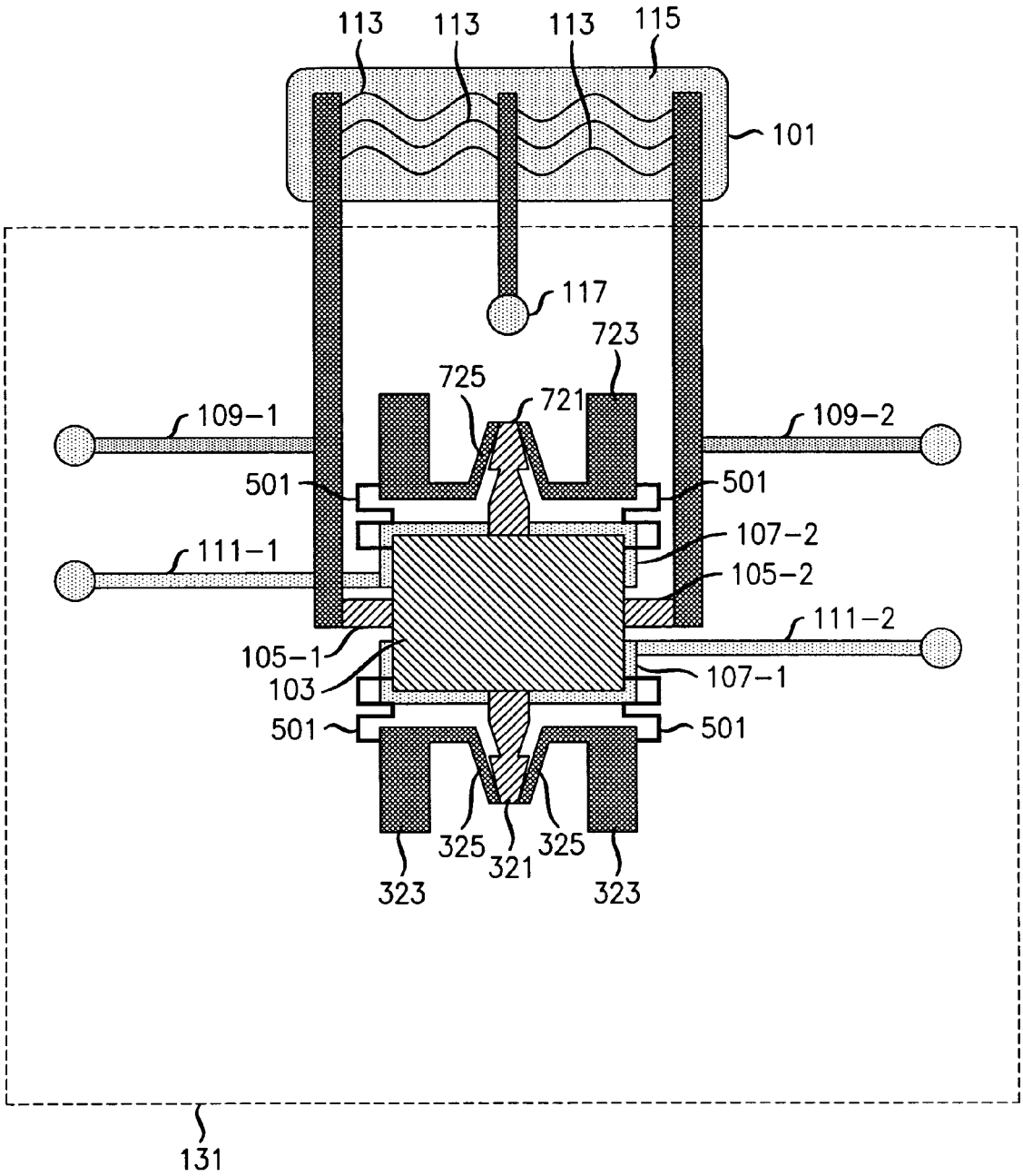
FIG. 7 shows another exemplary embodiment of the invention, similar to that shown in FIG. 6, but also including an additional locking mechanism.

FIG. 7 shows another exemplary embodiment of the invention, similar to that shown in FIG. 6, but also including an additional locking mechanism made up of lockable tab 721 and lock receptacle 723,which includes locking arms 725. Again, as in FIG. 6, not only do springs 501 prevent mass 103 from moving around freely, mass 103 is also locked in place by the insertion of tab 321 into lock receptacle 323, when it moves toward lock receptacle 323. Additionally, should mass 103 move toward lock receptacle 723, it is locked therein by locking arms 725 grabbing lockable tab 721. Thus, the embodiment of FIG. 7 is suitable to be operated with acceleration in any one of two directions.

Figure 8:
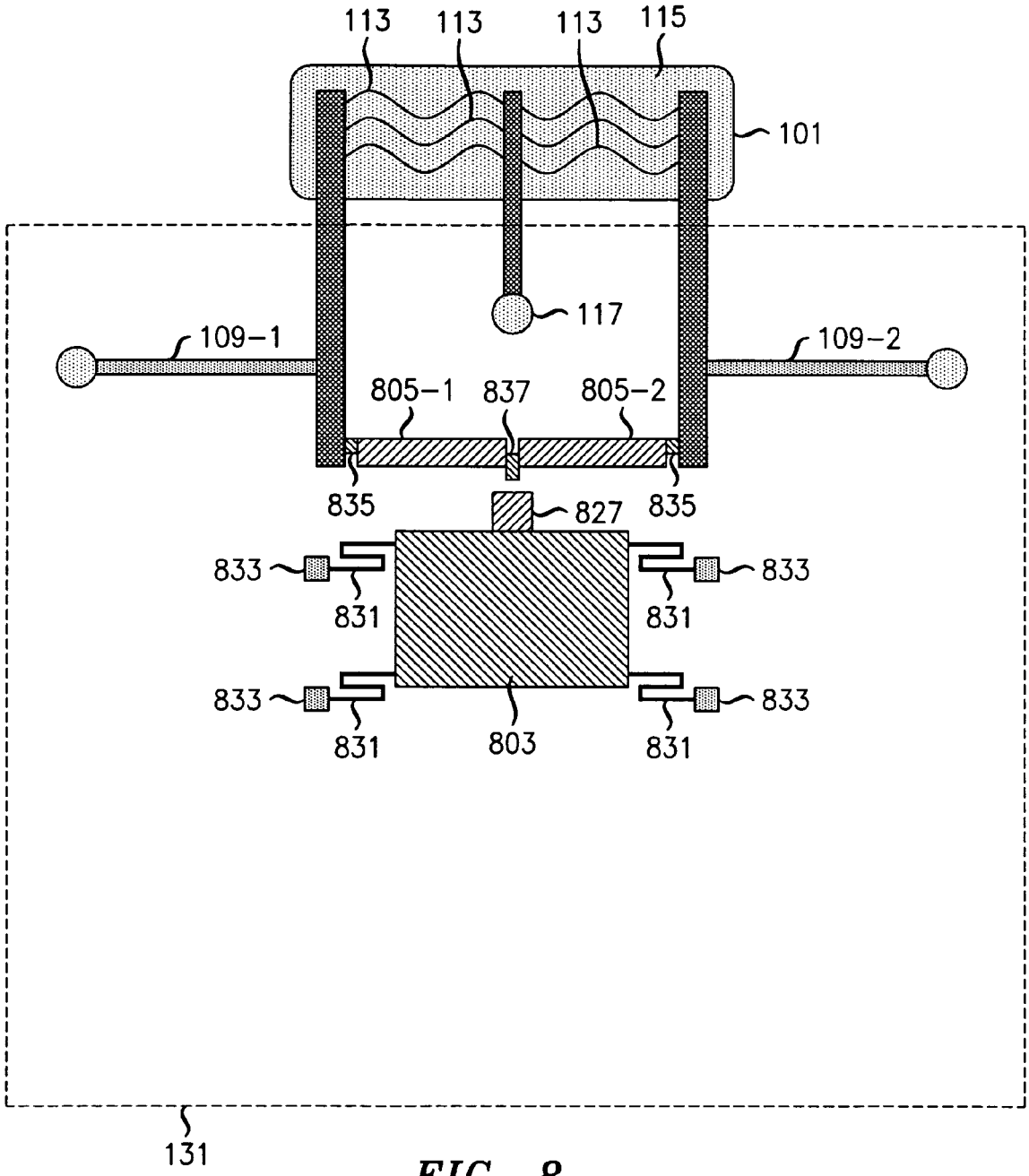
FIG. 8 shows another exemplary embodiment of the invention in which the mass is not connected to the bridges.

FIG. 8 shows another exemplary embodiment of the invention in which the mass is not connected to the bridges, as in FIG. 1. Instead, sufficient movement of mass 803 toward relatively high impedance trigger 101 causes head 827 to strike target point 837 so as to destroy the low impedance connection from electrical connection and test ports 109-1 to 109-2 by disconnecting at least one of bridges 805 at at least one of weak points 835 or target point 837 from the circuit. Mass 803 is coupled via springs 831, which are similar to springs 501, to posts 833. Springs 831 are such that under prescribed acceleration conditions, mass 827 can move to strike target point 832, thereby disrupting the low impedance circuit.

Figure 9:
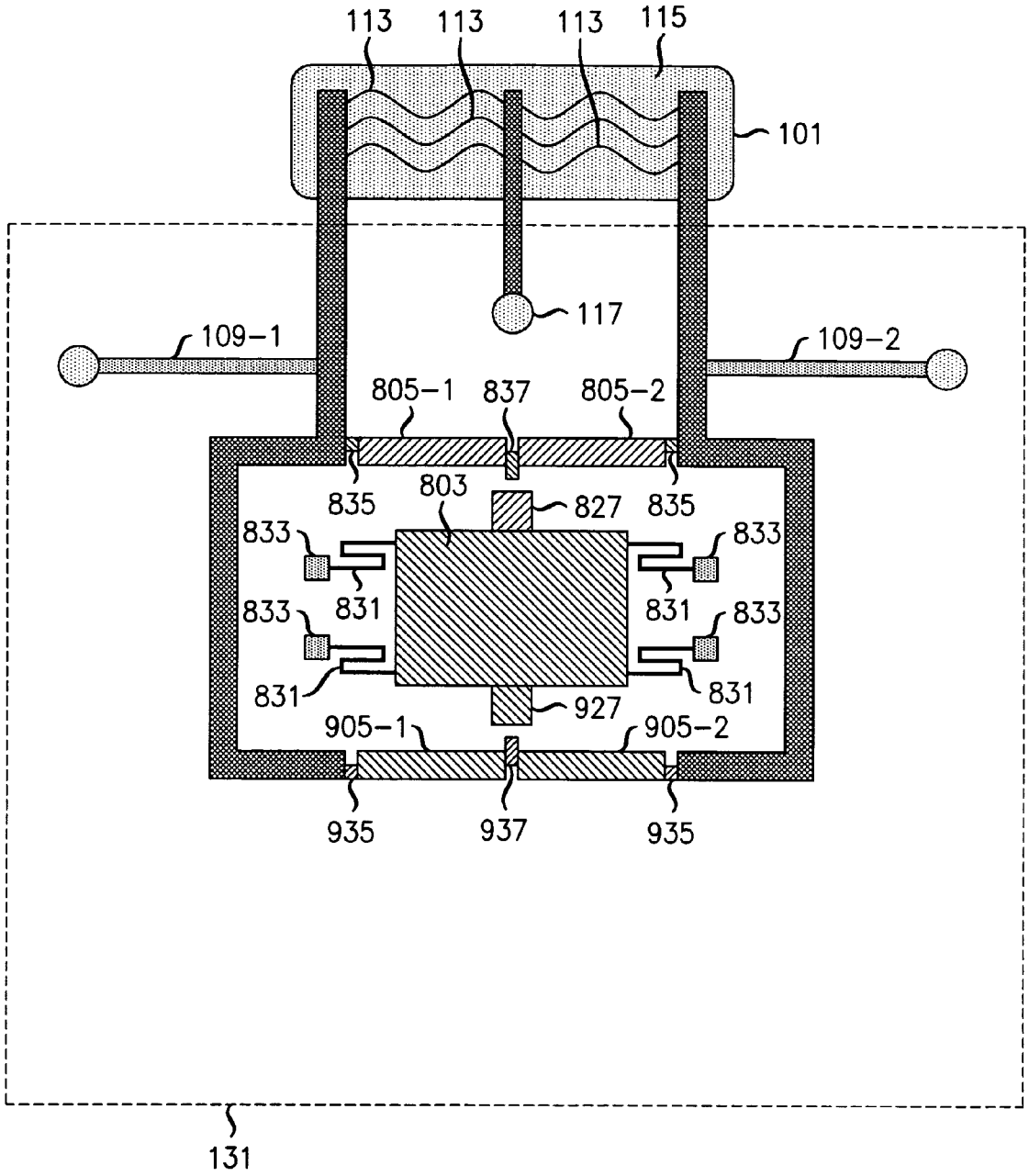
FIG. 9 shows another exemplary embodiment of the invention that is similar to the embodiment of the invention shown in FIG. 8 but in which acceleration towards the slapper and away from the slapper is required before an explosion is triggered.

FIG. 9 shows another exemplary embodiment of the invention that is similar to the embodiment of the invention shown in FIG. 8 but in which acceleration toward relatively high impedance trigger 101 and away from relatively high impedance trigger 101 is required before an explosion is triggered. Regarding acceleration toward relatively high impedance trigger 101, the embodiment of FIG. 9 operates as does that of FIG. 8. In addition, movement of mass 803 away from relatively high impedance trigger 101 causes head 927 to strike target point 937 so as to destroy the additional branch of the low impedance connection from electrical connection and test ports 109-1 to 109-2 by disconnecting at least one of bridges 905 at at least one of weak points 935 or target point 937 from the circuit. Only when both branches of the low impedance connection from electrical connection and test ports 109-1 to 109-2 are destroyed does sufficient current to cause a triggering of the explosion flow through relatively high impedance trigger 101.

What is claimed is:

1. A fuse, comprising:

a relatively high impedance trigger;

a bypass circuit with a relatively low impedance compared to the impedance of said trigger, said bypass circuit being coupled in parallel with said trigger; and a micro mechanical device operable to disrupt said bypass circuit by physically destroying at least one portion of said bypass circuit.

2. The invention as defined in claim 1 wherein said micro mechanical device is contained within a sealed package, and said relatively high impedance trigger is outside of said sealed package.

3. The invention as defined in claim 1 wherein movement of at least a part of said micro mechanical device disrupts said bypass circuit.

4. The invention as defined in claim 1 wherein movement of at least a part of said micro mechanical device disrupts said bypass circuit, and said micro mechanical device is adapted to perform said movement only when prescribed conditions are met.

5. The invention as defined in claim 1 wherein said micro mechanical device is a micro-electrical mechanical system (MEMS) device including at least one spring that is electrically part of said bypass circuit and wherein said bypass circuit is disrupted by movement of said MEMS device such that said at least one spring is broken.

6. The invention as defined in claim 1 wherein disrupting of said bypass circuit allowing an applied current of sufficient magnitude to flow through said trigger stimulating an explosion.

7. The invention as defined in claim 1 wherein disrupting of said bypass circuit enables a current of sufficient magnitude, when supplied, to flow through said trigger.

8. The invention as defined in claim 1 wherein said bypass circuit is a bridge that is disrupted by being broken by an impact with said micro mechanical device as a result of its motion.

9. The invention as defined in claim 8 wherein said bridge is a part of said micro mechanical device.

10. The invention as defined in claim 8 wherein said bridge is not a part of said micro mechanical device.

11. The invention as defined in claim 1 wherein movement of at least a part of said micro mechanical device disrupts said bypass circuit, and wherein said micro mechanical device is latched into a new position after its movement.

12. The invention as defined in claim 1 wherein a sequence of at least two movements of said micro mechanical device are required to disrupt said bypass circuit.

13. The invention as defined in claim 1 wherein said micro mechanical device has multiple movable parts, each of which must move in a respective prescribed manner in order to disrupt said bypass circuit.

14. The invention as defined in claim 1 wherein said relatively high impedance trigger is a slapper.

15. The invention as defined in claim 1 further comprising test points arranged to couple a test voltage across the parallel circuit made up of said relatively high impedance trigger and said bypass circuit wit a relatively low impedance so that the resulting current may be measured.

16. The invention as defined in claim 1 further comprising test points arranged to couple a test voltage across at least part of said relatively high impedance trigger so that the resulting current may be measured.

17. The invention as defined in claim 1 further comprising;

at least one electrode positioned so that a voltage between said electrode and said micro mechanical device causes said micro mechanical device to move; and test ports for measuring capacitance between said at least one electrode and said micro mechanical device.

18. The invention as defined in claim 1 wherein said micro mechanical device must move in at least two directions to disrupt said bypass circuit.

19. The invention as defined in claim 18 wherein said directions are substantially opposite to each other with respect to a local coordinate system of said fuse.

20. A fuse, comprising:

means for triggering an explosion, said means for triggering an explosion having a relatively high impedance;

means for bypassing said means for triggering with a relatively low impedance compared to the impedance of said means for triggering, said means for bypassing being coupled in parallel with said means for triggering; and micro mechanical means for disrupting, under at least one prescribed condition, the ability of said means for bypassing to bypass said means for triggering by physically destroying at least one portion of said means for bypassing.

21. The invention as defined in claim 20 wherein said micro mechanical means for disrupting is contained within a sealed package, and said means for triggering an explosion is outside of said sealed package.

22. The invention as defined in claim 20 further comprising means for testing the integrity of said means for triggering.

23. The invention as defined in claim 20 further comprising means for testing the integrity of said means for bypassing.

24. The invention as defined in claim 20 further comprising means for testing the motion ability of said micro mechanical means for disrupting.

25. The invention as defined in claim 20 further comprising means for latching said micro mechanical means after said at least one prescribed condition has been met.

26. The invention as defined in claim 20 wherein under said at least one prescribed condition said micro mechanical means for disrupting moves in a first direction.

27. The invention as defined in claim 20 wherein under said prescribed condition said micro mechanical means for disrupting moves initially in a first direction and subsequently in a second direction prior to said means for bypassing being disrupted.

28. The invention as defined in claim 20 wherein under said prescribed condition said micro mechanical means for disrupting moves in a first direction with at least a minimum prescribed acceleration.

29. The invention as defined in claim 20 wherein said means for disrupting is integral to said means for bypassing.

30. The invention as defined in claim 20 wherein said means for disrupting is external to said means for bypassing.

31. A method for use in a fuse, the method comprising the step of disrupting the low impedance bypassing of a comparatively high impedance trigger by the motion of a micro mechanical device in a manner that physically destroys at least one component of a circuit that is providing said low impedance bypassing.

32. The invention as defined in claim 31 further comprising the step of latching said micro mechanical device after completion of said disrupting step.

33. The invention as defined in claim 31 further wherein said disrupting step further comprises the step of breaking at least one bridge in a circuit performing said low impedance bypassing.

34. A method for use with a fuse, comprising a relatively high impedance trigger, a bypass circuit with a relatively low impedance compared to the impedance of said trigger, said bypass circuit being coupled in parallel with said trigger, and a micro mechanical device operable to disrupt said bypass circuit by physically destroying at least one portion of said bypass circuit, the method comprising the step of testing the electrical integrity of said relatively high impedance trigger.

35. A method for use with a fuse, comprising a relatively high impedance trigger, a bypass circuit with a relatively low impedance compared to the impedance of said trigger, said bypass circuit being coupled in parallel with said trigger, and a micro mechanical device operable to disrupt said bypass circuit by physically destroying at least one portion of said bypass circuit, the method comprising the step of testing the electrical integrity of said relatively low impedance bypass circuit.

36. A method for use with a fuse, comprising a relatively high impedance trigger, a bypass circuit with a relatively low impedance compared to the impedance of said trigger, said bypass circuit being coupled in parallel with said trigger, and a micro mechanical device operable to disrupt said bypass circuit by physically destroying at least one portion of said bypass circuit, the method comprising the step of testing the ability of said micro mechanical device to move.

* * * * *